US012752166B2

(12) United States Patent
Kelly

(10) Patent No.: US 12,752,166 B2
(45) Date of Patent: Oct. 6, 2026

(54) SPORT HANDLE BOTTOM—EXTERNAL UTILITY MOUNT

(71) Applicant: Peter B Kelly, Lyndhurst, NJ (US)

(72) Inventor: Peter B Kelly, Lyndhurst, NJ (US)

( * ) Notice: Subject to any disclaimer, the term of this patent is extended or adjusted under 35 U.S.C. 154(b) by 316 days.

(21) Appl. No.: 18/416,695

(22) Filed: Jan. 18, 2024

(65) Prior Publication Data

US 2024/0245963 A1 Jul. 25, 2024

Related U.S. Application Data

(60) Provisional application No. 63/440,676, filed on Jan. 23, 2023.

(51) Int. Cl.

| | |
|---|---|
| ***A63B 49/00*** | (2015.01) |
| ***A63B 49/08*** | (2015.01) |
| ***A63B 60/00*** | (2015.01) |
| ***A63B 60/08*** | (2015.01) |
| *A63B 102/10* | (2015.01) |

(52) U.S. Cl.

CPC ..... *A63B 60/08* (2015.10); *A63B 49/08* (2013.01); *A63B 2102/10* (2015.10)

(58) Field of Classification Search

CPC ..... A63B 60/08; A63B 49/08; A63B 2102/10; A63B 2209/10; A63B 2210/50; A63B 60/60; A63B 71/0045

USPC ..... 473/549

See application file for complete search history.

(56) References Cited

U.S. PATENT DOCUMENTS

| | | | | | |
|---|---|---|---|---|---|
| 2,506,197 | A * | 5/1950 | Burger | B62K 21/26 | 74/551.8 |
| 2,508,812 | A * | 5/1950 | Burger | B62K 21/26 | 74/551.8 |
| 4,114,881 | A * | 9/1978 | Norton | A63B 49/08 | 473/517 |
| 4,265,448 | A * | 5/1981 | Anderson, Jr. | A63B 69/38 | 473/553 |
| 4,508,478 | A * | 4/1985 | Leistner | F16B 37/048 | 411/176 |
| 4,591,156 | A * | 5/1986 | Attenni | A63B 60/16 | 24/265 R |
| 5,624,114 | A * | 4/1997 | Kelsey | A63B 60/14 | 473/457 |
| 5,785,617 | A * | 7/1998 | MacKay, Jr. | A63B 59/50 | 473/566 |
| 5,823,729 | A * | 10/1998 | Nagayama | F16B 37/145 | 411/429 |
| 5,893,765 | A * | 4/1999 | Farnworth | H10W 70/635 | 439/91 |
| 7,935,011 | B1 * | 5/2011 | Krbec | A63B 69/38 | 473/549 |

(Continued)

FOREIGN PATENT DOCUMENTS

| | | | |
|---|---|---|---|
| CN | 1968631 | A * | 5/2007 |
| CN | 101219268 | A * | 7/2008 |

(Continued)

*Primary Examiner* — Kiley S Stoner

(57) ABSTRACT

The present disclosure is directed to a Sport Handle Bottom—External Utility mount which is a specifically designed utility apparatus which attaches to the butt end or flat butt end of sport handles of many kinds. The mount is for further connecting to any other sport handle apparatus or accessory of numerous and varied designs for purposeful usage as desired by the User/Player.

10 Claims, 3 Drawing Sheets

(56) References Cited

U.S. PATENT DOCUMENTS

| | | | | |
|---|---|---|---|---|
| 8,801,534 | B1 * | 8/2014 | Rydberg | A63B 60/16 473/286 |
| 2005/0103769 | A1 * | 5/2005 | Marquis | A01K 87/085 219/204 |
| 2007/0049396 | A1 * | 3/2007 | Scheibe | A63B 47/02 473/282 |
| 2008/0069660 | A1 * | 3/2008 | Selle | F16B 39/34 411/179 |
| 2014/0335967 | A1 * | 11/2014 | Schacht | A63B 49/035 473/437 |
| 2015/0086294 | A1 * | 3/2015 | Selle | F16B 23/0023 470/11 |
| 2018/0015340 | A1 * | 1/2018 | Codd | A63B 60/24 |
| 2021/0283469 | A1 * | 9/2021 | Nelson | A63B 60/16 |
| 2022/0145926 | A1 * | 5/2022 | Wessels | F16B 33/006 |
| 2022/0157277 | A1 * | 5/2022 | Conrad | G10G 5/005 |
| 2025/0213945 | A1 * | 7/2025 | Matthes | A63B 69/0002 |

FOREIGN PATENT DOCUMENTS

| | | | | | |
|---|---|---|---|---|---|
| CN | 105944346 | A | * | 9/2016 | B67B 7/16 |
| CN | 106243735 | A | * | 12/2016 | C08L 83/04 |
| CN | 214199142 | U | * | 9/2021 | |
| EP | 3154648 | B1 | * | 12/1994 | A63B 60/54 |
| ES | 2574907 | T3 | * | 6/2016 | B62D 27/04 |
| GB | 2194185 | A | * | 3/1988 | B23P 19/062 |
| JP | S62200741 | U | * | 12/1987 | |
| JP | H0719223 | A | * | 1/1995 | |
| JP | 2724179 | B2 | * | 3/1998 | A63B 60/16 |
| JP | H10252732 | A | * | 9/1998 | |
| JP | 2012045353 | A | * | 3/2012 | |
| JP | 2014014917 | A | * | 1/2014 | |
| JP | 2020178796 | A | * | 11/2020 | |
| KR | 200373484 | Y1 | * | 1/2005 | B63B 73/20 |
| KR | 20070029031 | A | * | 3/2007 | E02B 3/26 |
| WO | WO-9428980 | A1 | * | 12/1994 | A63B 60/54 |

* cited by examiner

SPORT HANDLE BOTTOM—EXTERNAL UTILITY MOUNT

CROSS-REFERENCE TO RELATED APPLICATIONS

The present application is a Continuation of U.S. Non-Provisional Application No. 63/440,676, filed Jan. 23, 2023, and titled "MOUNTIE+– A SPORT RACKET AND PADDLE HANDLE BOTTOM—EXTERNAL UTILITY MOUNT" the full disclosure of which is hereby incorporated herein by reference in their entireties for all purposes.

BACKGROUND

Inventor wishes to accessorize sport handle bottoms of many kinds whereby the sport handle users who wish to connect any other type of apparatus or accessory designed to benefit the sport player in any way including obtaining any kind of mental and/or physical benefit, or positive reassurance. Attaching apparatus or accessories such as but not limited to: training equipment, small weights (less than 1 ounce), ball pickup assistant equipment, hooks, bands, rings, design tags, or string/rope for hanging or carrying accessory decor and keepsake trinkets/collectibles, or fashion paraphernalia, and more—all of which can be used in conjunction with the Sport Handle Bottom—External Utility Mount.

The Sport Handle Bottom—External Utility mount is a specifically designed utility apparatus which attaches to the butt end or flat butt end of sport handles of any kind—such as but not limited to: rackets; i.e. tennis, badminton, and racquetball rackets. Paddles; i.e. pickleball, beach, paddleball, and ping pong paddles. Bats; i.e. softball, baseball, cricket, stickball and wiffle ball bats. Sticks; i.e. lacrosse, hockey, and billiard sticks. Curling brooms. Bikes and scooters; i.e. any kind of manually powered or motorized bike and scooter. Ski poles, fishing rods, and golf clubs, or any other sport handle bottom not listed here.

The Sport Handle Bottom—External Utility Mount is a threaded metal, or plastic round hollow receptor tube which is to be used as a female receptor for further connecting to any other sport handle apparatus or accessory. It can be attached by a supporting cap (made of any flexible material, typically silicone, rubber or TPU) that can hold the receptor tube to the butt end or flat butt end of sport handles of any kind by being screwed, glued, or any other type of adhering substance or device that would secure it to the flat butt end of a sport handle.

The utility patent is for attaching an external utility mount to any sport handle bottom for which a player or user decides to attach any other apparatus or accessory as desired and as described above and below. It does not necessarily need to be a Cap and/or receptor tube that enables someone to attach any apparatus or accessory to the flat butt end of a sport handle.

TECHNICAL FIELD

The technology described herein relates to a Sport Handle Bottom—External Utility mount which is a specifically designed utility apparatus that attaches to the butt end or flat butt end of sport handles. the Sport Handle Bottom—External Utility Mount is intended to be used in conjunction with other player desired apparatus and/or accessories as described below in the Background and Summary sections.

SUMMARY

The Sport Handle Bottom—External Utility Mount is conceptually conceived and uniquely designed to attach to the external sport handles bottom (AKA butt end or flat butt end of the handle). Please note, the Sport Handle Bottom—External Utility Mount can be built into or inside the sport handle, or just below the external surface of the sport handle bottom (butt end). Once again, the Sport Handle Bottom—External Utility Mount is intended to be used in conjunction with other player desired apparatus and/or accessories as described above.

DETAILED DESCRIPTION

Figure 1:
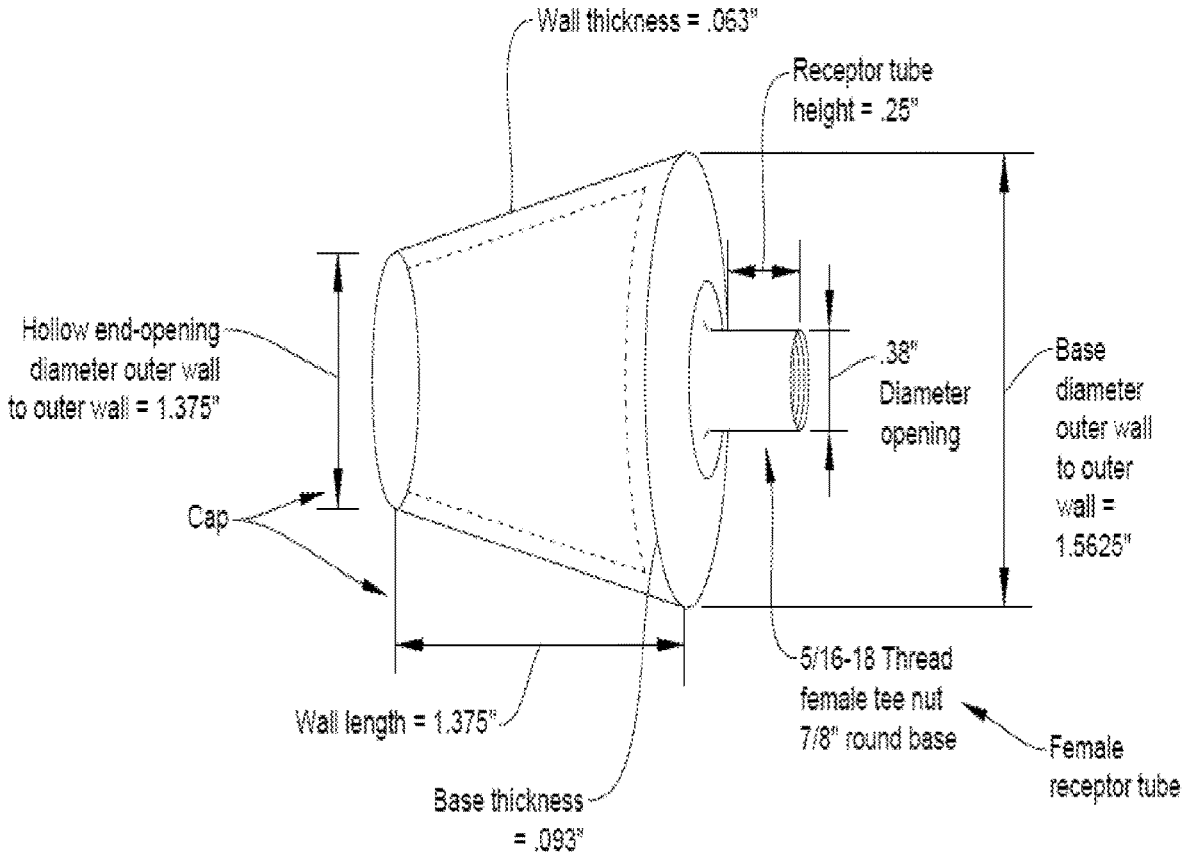
FIG. 1—Perspective view of the sport handle butt end mount.
Figure 2:
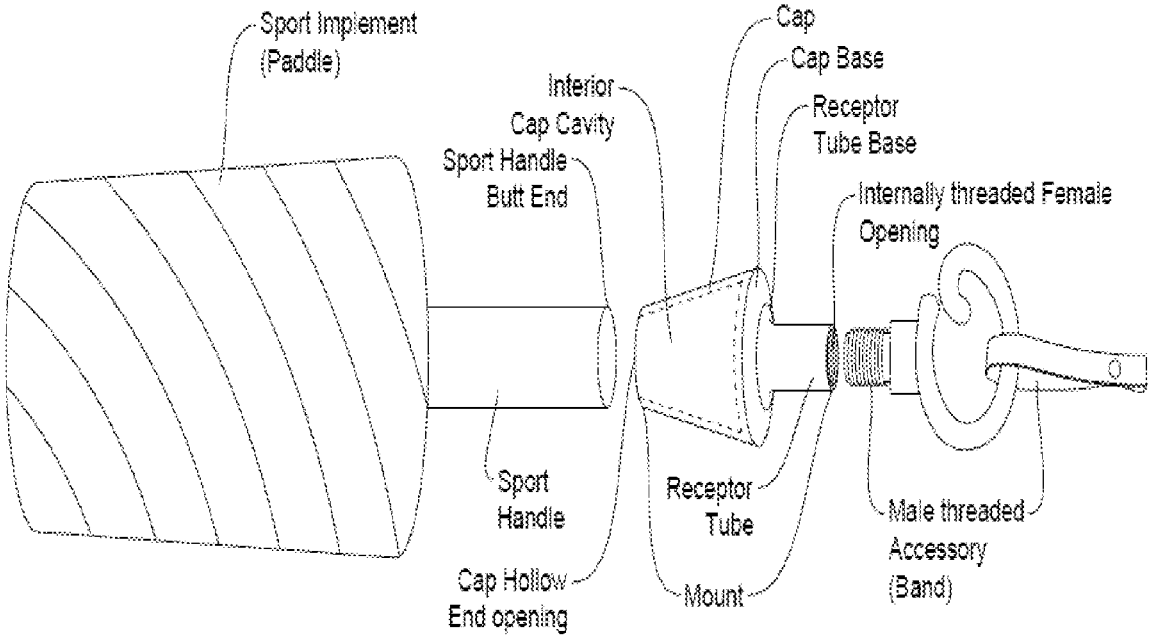
FIG. 2—View of the system comprising the mount along with a sport implement—paddle (pickleball paddle) with the sport handle and the sport handle butt end and the complementary customized accessory—a band, aligned for assembly yet still unconnected.
Figure 3:
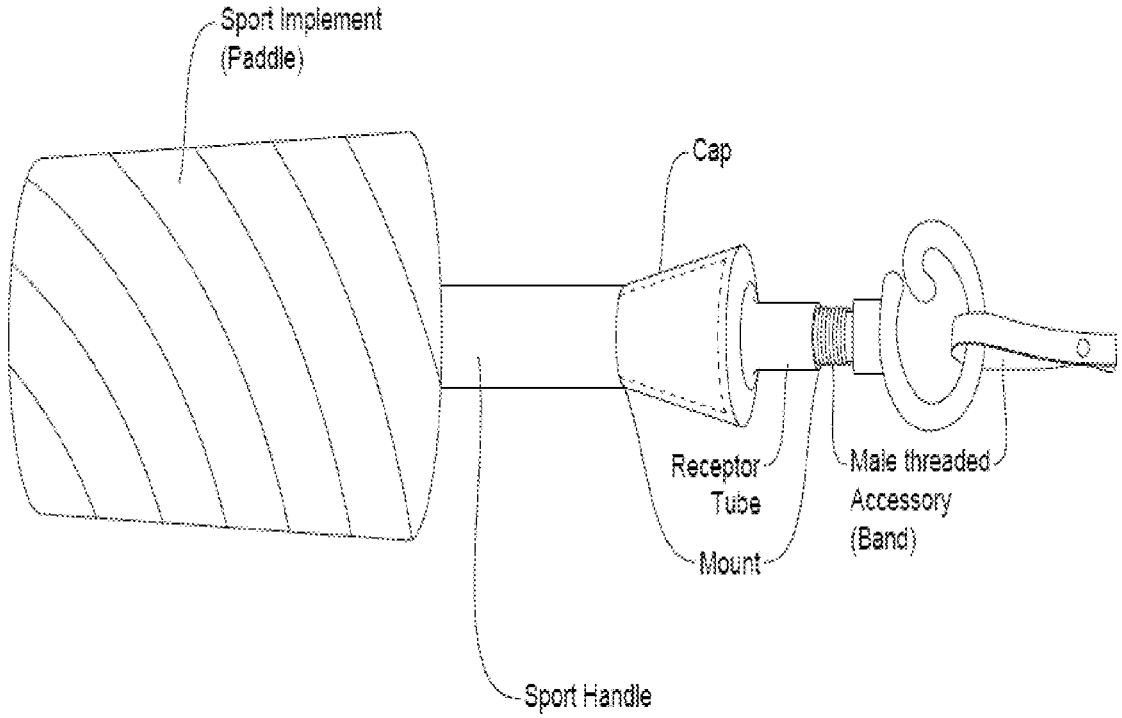
FIG. 3—View of the system comprising the mount along with a sport implement—paddle (pickleball paddle) with the sport handle and the sport handle butt end and the complementary customized accessory—a band, all connected and assembled.

A two-piece unit including a silicon, rubber, or TPU Cap to slide over the sport handle flat butt end and a female receptor tube (as described above) made of plastic or metal. This two-piece unit can be manufactured as one unit whereby the receptor tube is built into the Cap. Or, it can be manufactured as two separate units whereby the receptor tube can be manufactured separately and inserted into the Cap.

The Cap dimensions, for illustrative purposes, following dimensions of the Cap is for a size "Medium". There is also a "Small" size, yet any size variation of the mounting utility unit is permissible as this patent is focused on the utility concept of using a Sport Handle Bottom—External Utility Mount to further attach apparatus and/or accessories to the Sport Handle Bottom—External Utility Mount. It does not necessarily need to be a Cap and/or receptor tube that enables someone to attach any apparatus or accessory to the flat butt end of a sport handle. The hollow cap open end diameter, outer wall to outer wall is 1.375" with Cap wall thickness=0.63". The Cap wall length from hollow end to the base=1.375". The Cap base diameter=1.5625". The Cap base thickness=0.93". —Material: Silicon, rubber, or TPU.

Receptor Tube (female receptor) dimensions, for illustrative purposes, the following dimensions of the Receptor Tube is for both the "Medium" size and "Small" size Caps, yet any size variation of the mounting Receptor Tube utility unit is permissible as this patent is focused on the utility concept of using a Sport Handle Bottom—External Utility Mount to further attach apparatus and/or accessories to the Sport Handle Bottom—External Utility Mount. It does not necessarily need to be a Cap and/or receptor tube that enables someone to attach any apparatus or accessory to the flat butt end of a sport handle. The Receptor Tube opening diameter=0.38". The Receptor Tube thread=5/16-18. The Receptor Tube height=0.25". The Receptor Tube round base diameter=⅞".

The material of the Receptor Tube is typically Plastic or Metal.

Note: The above design specifications may be slightly modified by realistic and acceptable deviations depending upon player customization requests, the Sport Handle Bottom—External Utility Mount creator or owner requests, and/or manufacturers recommendations. For example, other size dimensions and materials of the Cap and/or the receptor tube/nut are also acceptable. The utility patent is for attaching an external utility mount to any sport handle bottom for which a player or user decides to attach any other apparatus or accessory as desired and as described above. It does not necessarily need to be a Cap and/or receptor tube that enables someone to attach any other apparatus or accessory to the flat butt end of a sport handle.

I claim:

1. A system comprising: a sport implement with a sport handle having a butt end; an attachable and removable mount that slides over the butt end of the sport handle, wherein the mount consists of a flexible hollow circular cap with a built-in receptor tube that has an internally threaded female opening; and a male accessory threadedly attached to the internally threaded female opening of the receptor tube.

2. The system of claim 1, wherein the cap comprises silicon, rubber, or TPU.

3. The system of claim 1, wherein the cap comprises a cap base and a hollow open end with an interior cavity sized to receive the butt end of the sport handle.

4. The system of claim 1, wherein the receptor tube is built-into a cap base.

5. The system of claim 1, wherein a hollow open end of the cap is 1.375" in diameter, a cap wall length from the cap hollow open end to a cap base is 1.375", the cap base diameter is 1.5625", and the cap base thickness is 0.093".

6. The system of claim 1, wherein the receptor tube comprises a receptor tube base and the internally threaded female opening extends from a cap base in an axial direction of the sport handle butt end.

7. The system of claim 1, wherein the receptor tube comprises plastic material.

8. The system of claim 1, wherein the receptor tube internally threaded female opening diameter is 0.38", the receptor tube thread size is 5/16-18, the receptor tube height is 0.25", and a receptor tube base diameter is 0.42".

9. The system of claim 1, wherein the sport implement is a tennis racket, badminton racket, racquetball racket, pickleball paddle, beach paddle, paddleball paddle, ping pong paddle, softball bat, baseball bat, cricket bat, stickball bat, wiffle ball bat, lacrosse stick, hockey stick, billiard stick, curling broom, bike, scooter, ski pole, fishing rod, or golf club.

10. The system of claim 1, wherein the accessory is a band, ring, design tag, keepsake trinket, collectible, or fashion paraphernalia.

* * * * *